United States Patent [19]

Saito et al.

[11] Patent Number: 4,786,931

[45] Date of Patent: Nov. 22, 1988

[54] IMAGE RECORDING APPARATUS

[75] Inventors: Minoru Saito; Yoshiyuki Monma; Shin-ichi Ichikawa, all of Kanagawa, Japan

[73] Assignee: Fuji Photo Film Co., Ltd., Kanagawa, Japan

[21] Appl. No.: 25,698

[22] Filed: Mar. 13, 1987

[30] Foreign Application Priority Data

Mar. 14, 1986 [JP] Japan ..... 61-056702

[51] Int. Cl.[4] ..... G03D 5/06

[52] U.S. Cl. ..... 354/303; 354/305; 354/318; 118/246

[58] Field of Search ..... 354/301, 303, 305, 317, 354/318, 339; 430/203, 403; 118/246, 247, 249, 676, 679, 680

[56] References Cited

U.S. PATENT DOCUMENTS 3,672,326 6/1972 Schulze ..... 118/680

3,862,553 1/1975 Schwemmer et al. ..... 118/246

4,629,675 12/1986 Takehara et al. ..... 354/303

FOREIGN PATENT DOCUMENTS 59-75247 4/1984 Japan .

*Primary Examiner*—A. A. Mathews

*Attorney, Agent, or Firm*—Sughrue, Mion, Zinn, Macpeak & Seas

[57] ABSTRACT

Disclosed is an image recording apparatus which allows an image to be formed on an image receiving material by transferring an image recorded on a heat-developable light-sensitive material thereto in the presence of an image forming solvent. The rotational speed of a roller for coating the solvent onto the light-sensitive material or the image receiving material is controlled in the vicinity of the backward end of the light-sensitive material or image receiving material at a predetermined value or below. In consequence, suitable control of the amount of solvent to be applied is enabled.

21 Claims, 7 Drawing Sheets

IMAGE RECORDING APPARATUS

BACKGROUND OF THE INVENTION

The present invention relates to an image recording apparatus which allows an image to be formed on an image receiving material by transferring the image recorded on a heat-developable light-sensitive photographic material onto the image receiving material in the presence of an image forming solvent.

DESCRIPTION OF THE RELATED ART

Image recording apparatuses which employ a heat-developable light-sensitive photographic material to obtain color images have heretofore been known, one example thereof being described in, for example, the specification of Japanese Patent Laid-Open No. 75247/1984. In these apparatuses, a heat-developable light-sensitive material is image exposed in the exposing section and then fed to a heat-developing section, after which the heat-developed light-sensitive material is brought into tight contact with an image receiving paper onto which the image is transferred by means of a transfer process.

In the apparatuses described above, the image receiving paper generally has a transfer assistant (an image forming solvent) such as water applied to it before it is fed to the transfer section in order to improve transfer efficiency.

This water application is performed by means of a roller impregnated with water in the apparatus described in Japanese Patent Laid-Open No. 75247/1984. However, no consideration is taken into the amount of water to be applied.

An apparatus in which water is applied to an image receiving paper by passing it through a water tank before it is fed to a transfer section has been proposed. In this method, however, it is difficult to control the amount of water to be applied. Further, water is applied to the image receiving paper on the front and back surface thereof, and this makes the paper curl and requires a large amount of heat during heat transfer. In addition, since the entirety of the image receiving paper is coated with water, the water escapes together with the emulsion deposited on the image portion when the light-sensitive material and the image receiving paper are brought into close contact during transfer, and smears the conveying rollers or developing roller.

SUMMARY OF THE INVENTION

In view of the above-described problems of the prior art, it is an object of the present invention to provide an image recording apparatus which is capable of suitably controlling the amount of an image forming solvent such as water to be coated and thereby coating a predetermined amount of image forming solvent uniformly.

To this end, according to the present invention, there is provided an image recording apparatus which allows an image to be formed on an image receiving material by transferring the image recorded on a heat-developable light-sensitive material thereto in the presence of an image forming solvent, and which comprises a coating roller for coating the image forming solvent to the heat-developable light-sensitive material or the image receiving material, conveying means for conveying the heat-developable light-sensitive material or the image receiving material above the coating roller, and driving means for controlling the rotational speed of the coating roller.

According to the present invention, it is possible to control the amount of image forming solvent applied and thereby apply a sufficient amount of image forming solvent uniformly by controlling the rotational speed of the coating roller constituting coating means by the driving means and adjusting the length of an image forming solvent bead formed between the heat-developable light-sensitive material and the image receiving material.

In particular, it is possible not to apply excess water to the rear end of the image forming solvent coated portion of the heat-developable light-sensitive material or the image receiving material by slowing down or stopping the rotation of the roller at the rear end of the coated portion by means of the driving means and thereby reducing the size of the bead formed between the coating roller and the heat-developable light-sensitive material or the image receiving material.

In the image recording apparatus of the present invention, it is possible to separately provide a heat-developing section in which the exposed heat-developable light-sensitive material is heat developed and a transfer section in which the heat-developed light-sensitive material is brought into close contact with the image receiving material, and both being heated to transfer the image onto the image receiving material. Alternatively, they may be combined together, that is, a heat-developing/transferring section may be provided in which the exposed heat-developed sensitive material and the image receiving material are brought into close contact and both being heated to simultaneously perform heat-development and heat transfer.

The image recording apparatus of the present invention may employ a heat-developable light-sensitive material (a heat-developable light-sensitive element) and an image receiving material (color fixing element) of the types described in, for example, the specifications of U.S. Pat. No. 4,430,415, U.S. Pat. No. 4,483,914, U.S. Pat. No. 4,500,626, U.S. Pat. No. 4,503,137, Japanese Patent Laid-Open No. 154,445/1984, Japanese Patent Laid-Open No. 165,054, Japanese Patent Laid-Open No. 180,548/1984, Japanese Patent Laid-Open No. 218,443/1984, Japanese Patent Laid-Open No. 120,356/1985, Japanese patent application No. 209,563/1984, Japanese patent application No. 79,709/1985, Japanese patent application No. 169,585/1985, and Japanese patent application No. 244,873/1985.

The image forming solvent employed in this invention is required for forming an image, and it may be water, organic solvent having a low boiling point (such as alcohol, keton, amide), or a solvent of any of these to which various additives such as surface-active agent, accelerator and development terminator have been added.

DETAILED DESCRIPTION OF THE INVENTION

Embodiments of an image recording apparatus according to the present invention which allows for heat-development and heat transfer simultaneously will be hereinunder described by referring to the accompanying drawings.

Figure 2:
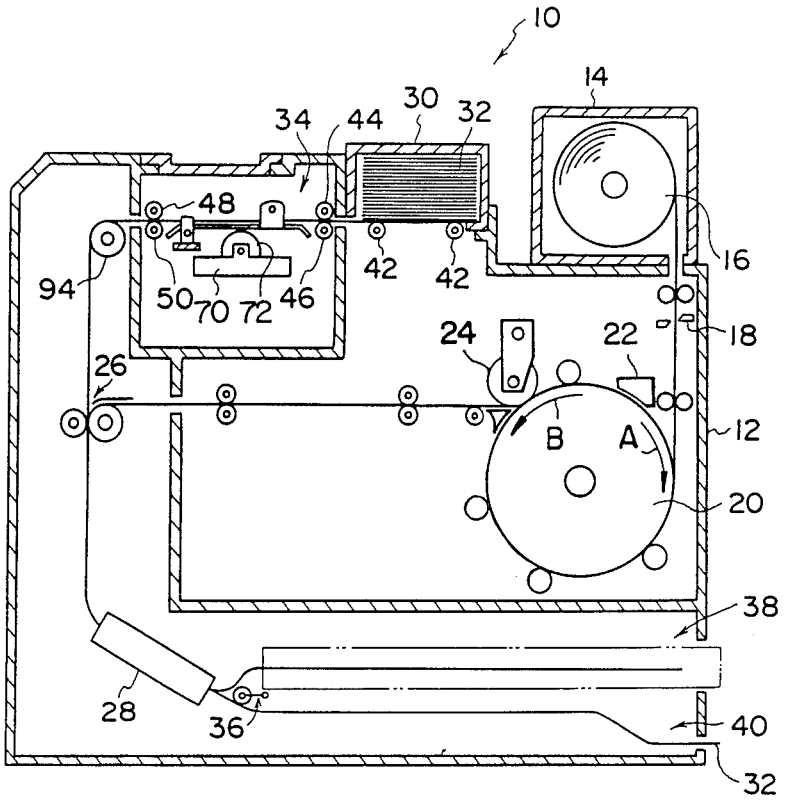
FIG. 2 is a longitudinal cross-sectional view of a first embodiment of the image recording apparatus according to the present invention.

FIG. 2 shows a first embodiment of the image recording apparatus 10 according to this invention.

The image recording apparatus has a magazine 14 mounted on a casing 12 for containing a heat-developable light-sensitive material 16. The light-sensitive material 16 which is drawn out of the magazine 14 is cut into desired lengths by a cutter 18, and is wound around the outer periphery of an exposure drum 20 incorporated in the casing 12 (in the direction of an arrow A). After being exposed on the outer periphery of the drum by an exposure head 22, the light-sensitive material is turned in the opposite direction (in the direction of an arrow B), scraped off the exposure drum by a scraper 24, then fed to a contacting section 26.

A piece of image receiving paper 32 which is accommodated in a cassette 30 is supplied via a water coating section 34 to the contacting section 26 where it is brought into close contact with the light-sensitive material 16, then both are fed to a heat-development/transfer section 28. A scraping section 36 is provided on the other side of the heat-development/transfer section 28, and thereafter the light-sensitive material 16 is fed to a collecting device 38 while the piece of image receiving paper 32 is fed to a port 40.

The pieces of image receiving paper 32 are driven by conveying rollers 42 rotatably supported on the casing 12 while they are accommodated in the cassette 30, and are sequentially fed to the water coating section 34 from the bottom.

The arrangement of the water coating section 34 will be described in detail below by referring to FIGS. 1, 3 and 4.

The water coating section 34 incorporates a pair of conveying rollers 44, 46 disposed adjacent to the cassette 30 so as to hold the conveyed pieces of image receiving paper 32 therebetween, and a pair of conveying rollers 48, 50 disposed beyond the conveying rollers 44, 46 for conveying the pieces of image receiving paper 32. The conveying rollers 48, 50 are driven by a motor (not shown), and are adapted to feed the pieces of image receiving paper 32 to the contacting section 26.

The water coating section 34 also includes a pair of guide plates 52, 54 along which the image transfer surface of the image receiving paper, or rather, the surface on which the photographic emulsion is deposited slide. These plates are provided in the passageway through which the pieces of image receiving paper 32 are conveyed between the rollers, and have a width which ensures that only the two lateral edges of the image receiving paper 32 are held thereby. They are separated from each other by a gap which is larger than the width of the image transfer portion P of the image receiving paper 32.

One end of each of the guide plates 52, 54 is fixedly secured to a shaft 56, while other ends thereof are supported by a shaft 57. One end of the shaft 56 is rotatably supported on the casing 12 (the rotatable support construction is not shown), and the other end thereof is connected to an output shaft of a motor 58 which is secured to the casing 12 and constitutes a main contacting and separating means.

Figure 1:
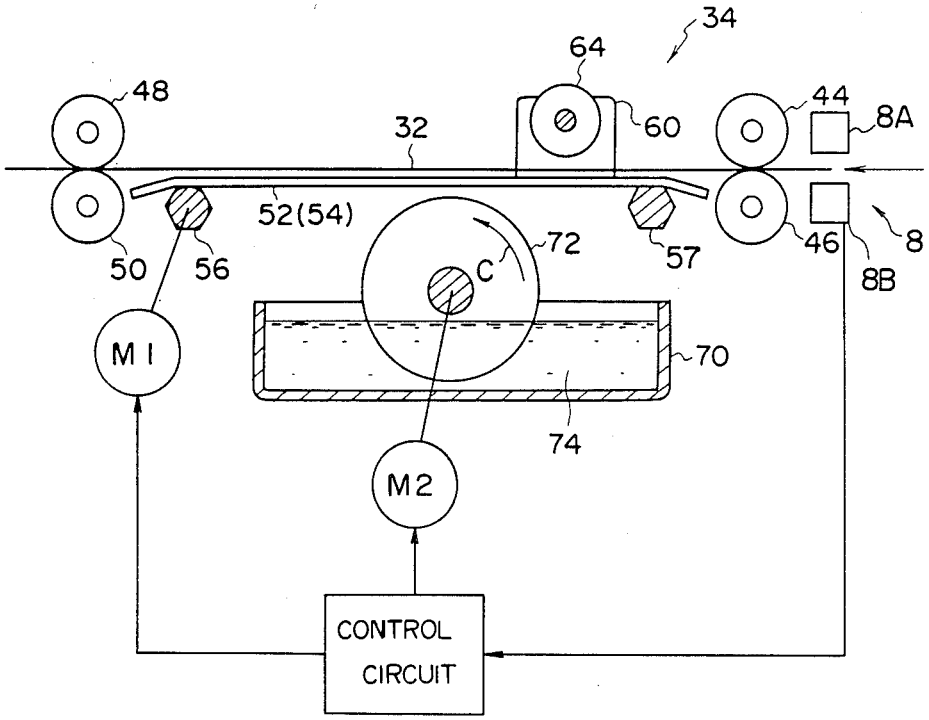
FIG. 1 is a longitudinal cross-sectional view of a water applying section incorporated in a first embodiment of an image recording apparatus according to the present invention.
Figure 3:
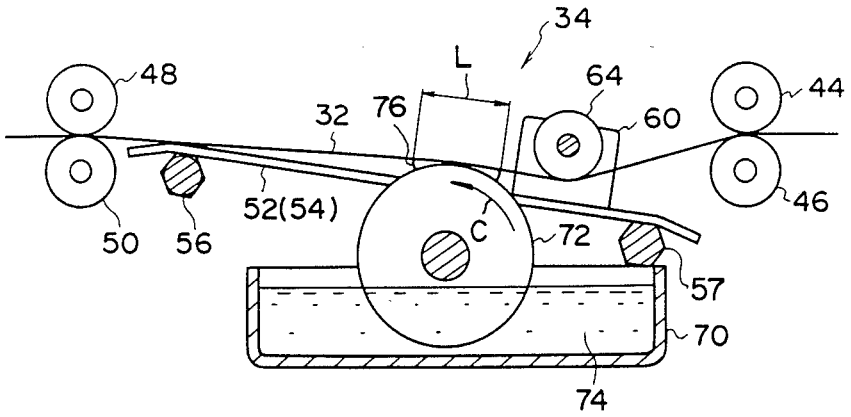
FIG. 3 illustrates the operation of the water applying section shown in FIG. 1.
Figure 4:
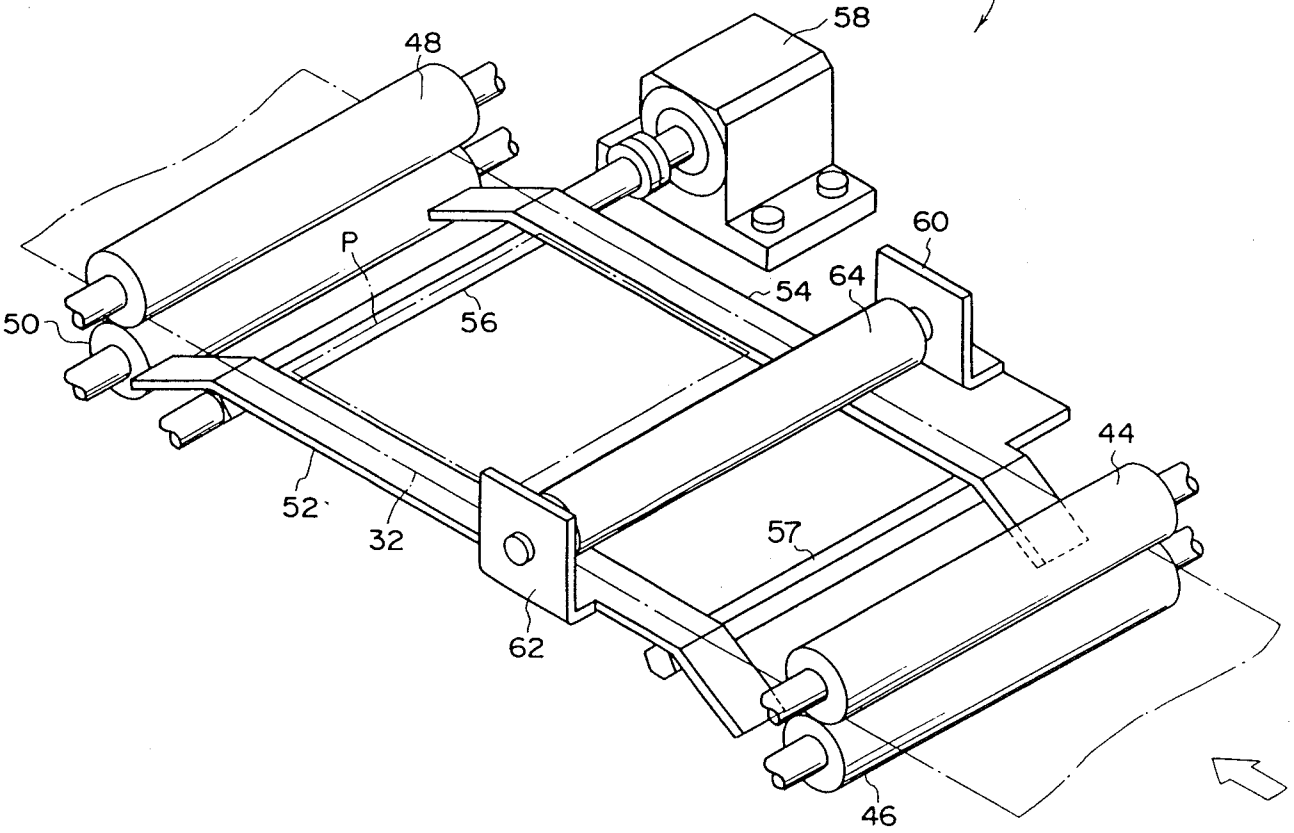
FIG. 4 is a perspective view of the water applying section shown in FIG. 1.

This arrangement of the guide plates 52, 54 enables the guide plates 52, 54 to be turned from the state shown in FIG. 1 in which they are level to the state shown in FIG. 3 in which they are inclined.

The guide plates 52, 54 respectively have integral rackets 60, 62 mounted thereon in the vicinity of the ends thereof which are closer to the conveying rollers 44, 46. A press roller 64 is rotatably supported between the brackets so as to press the image receiving paper 32 against a coating roller 72.

As shown in FIG. 1, the coating roller 72 is disposed below the guide plates 52, 54 in such a manner that the lower portion thereof is immersed in water contained in a water tank 70. The coating roller 72 is turned by the drive of a motor M2 in the direction of an arrow C, the direction in which the image receiving paper 32 is conveyed, so as to coat water 74 contained in the water tank 70, and which serves as an image forming solvent, onto the image receiving paper 32.

In consequence, the coating roller 72 may be a metal roller, a water absorbant roller made of sponge or felt or a plastic roller. The surface of the roller may be either flat or irregular, like a roughly-grooved roller.

The positional relationship between the coating roller 72 and the image receiving paper 32 is such that when the image receiving paper 32 is inclined together with the guide plates 52, 54, as shown in FIG. 3, the roller surface is in contact with the image receiving paper 32, but the image receiving paper 32 is separated from the coating roller 72 when the guide plates 52, 53 are level, as shown in FIG. 1, so that the water application is not provided.

As shown in FIG. 1, the water applying section further incorporates a sensor 8 for detecting the forward end and the rear end of each piece of image receiving paper 32, in front of the pair of conveying rollers 44, 46. The sensor 8 comprises a light-emitting element 8A and a light-detecting element 8B. Since light from the light-emitting element 8A is interrupted by the presence of the image receiving paper 32 between these elements 8A and 8B, the forward end and the rear end of the piece of image receiving paper 32 can be detected by judging whether or not light is received by the light-detecting element 8B. The sensor 8 is connected to a control circuit 6, which is in turn connected to the motor M1 which turns the shaft 56 and the motor M2 which rotates the coating roller 72.

Figure 7:
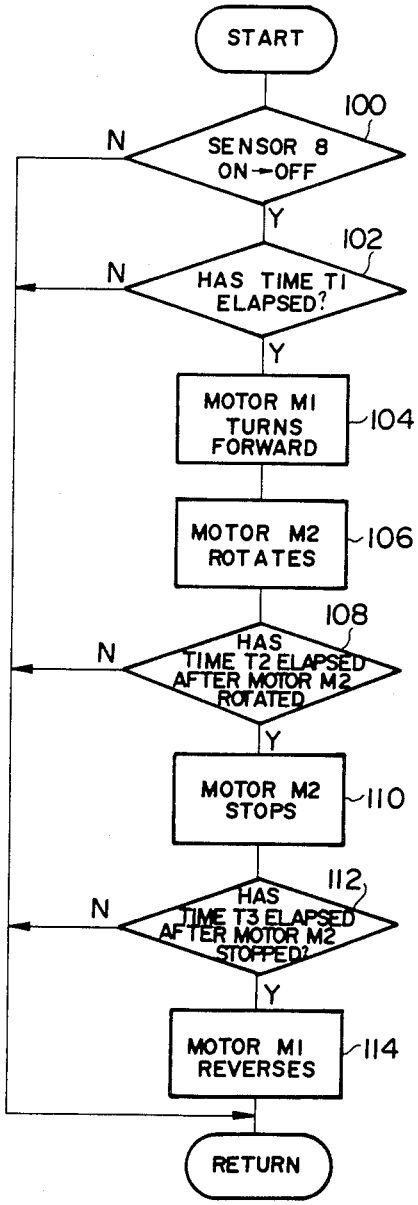
FIG. 7 is a flow chart of the operation of the apparatus according to the present invention.

The control circuit 6 has stored in it a control routine program which will be described below. As shown in FIG. 7, in Step 100, a judgement is made as to whether the output of the sensor is off or on, which determines whether or not the forward end of the piece of image receiving paper 32 has passed between the light-emitting element 8A and the light-detecting element 8B. If the result of the judgement in Step 100 is yes, the control circuit 6 judges in Step 102 whether or not a predetermined time T1 has elapsed. If the answer is yes, the motor M1 is turned in the forward direction in Step 104 so as to incline the guide plates 52, 54 and the motor M2 is rotated in Step 106 so as to drive the coating roller. The predetermined time in Step 102 corresponds to the time which it takes for the piece of image receiving paper 32 to be located right above the coating roller 72.

Next, in Step 108, a judgement is made as to whether or not a predetermined time T2 has elapsed after the start of the rotation of the motor M2, which determines whether or not the rear end of the piece of image receiving paper 32 has reached the vicinity of the coating roller 72. If the result of the judgement of Step 108 is yes, the rotation of the motor M2 is stopped in Step 110, so that the rotation of the coating roller 72 is stopped. The control circuit 6 then judges whether or not a predetermined time T3 has elapsed after the motor M2 stopped in Step 112, which determines whether or not the rear end of the piece of image receiving paper 32 has passed above the coating roller 72. If the answer of Step 112 is yes, the motor M1 is reversed in Step 114 so as to make the guide plates 52, 54 level.

Figure 5:
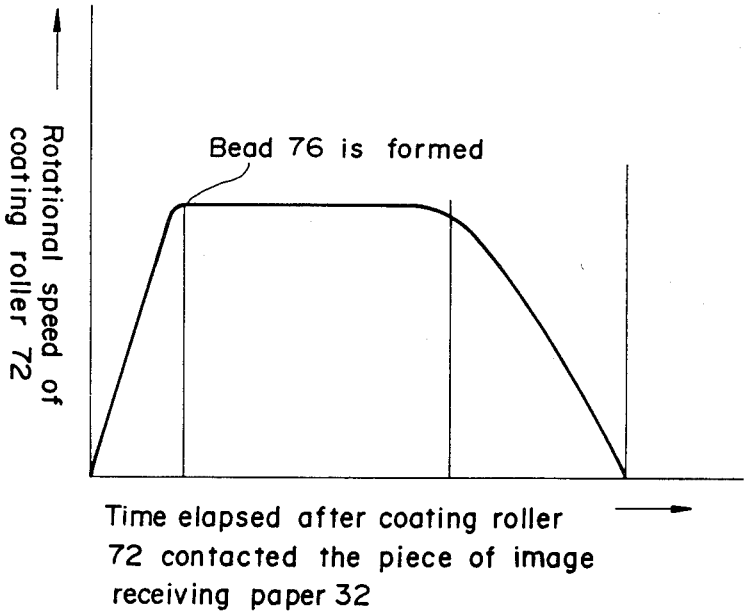
FIG. 5 is a graph of the rotational speed of a coating roller after the application is started.

FIG. 5 shows how the rotational speed of the coating roller 72 varies during coating as the coating time elapses. When the guide plates 52, 54 become inclined, as shown in FIG. 3, and the image receiving paper 32 comes into contact with the coating roller 72, the coating roller 72 starts to rotate, lifting up the water 74 contained in the water tank 70 and thereby forming a bead 76 between the image receiving paper 32 and the coating roller 72. During the application of water to the image receiving paper 32, the coating roller 72 is rotated at a given speed. As the operation of applying water to the image receiving paper 32 comes close to an end, when the rear end of the coated portion of the piece of image receiving paper 32 reaches the roller 72, the rotation of the coating roller 72 gradually slows down, and the bead 76 disappears.

The amount of water applied is determined by the degree to which the image receiving paper can be swelled, the speed at which the image receiving paper 32 swells, the rotational speed of the coating roller 72, the diameter thereof, and the feed speed of the image receiving paper 32.

In particular, it can be controlled to a high degree of accuracy by controlling the width L of the bead 76 accurately. Since the amount of water lifted up increases as the rotational speed of the coating roller 72 increases and the width L of the bead 76 increases as the diameter of the coating roller 72 increases, a desired amount of water application ca be obtained by setting the rotational speed of the coating roller 72 and the diameter thereof at given values.

The relationship between the width of the bead and the diameter and the rotational speed of the coating roller is expressed by the following equation:

$$Q \propto \frac{T \cdot D \cdot n}{v}$$

where Q is the amount of image forming solvent applied, T is the temperature of the image forming solvent, D is the diameter of the coating roller, n is the number of revolutions of the coating roller and v is the coating velocity.

As a result, accurate control of the amount of water applied is possible when using an inexpensive flat roller or a roughly-grooved roller in place of a gravure roll which has a finely grooved surface or a wire bar comprising a core and wire wound around the core.

The operation of the first embodiment of the apparatus will be described below.

The heat-developable light-sensitive material 16 conveyed from the magazine 14 is wound around the exposure drum 20. After being exposed by the exposure head 22, it is fed to the contacting section 26.

In the meantime, a plurality of pieces of image receiving paper 32 accommodated in the cassette 30 are sequentially fed to the water applying section 34 by means of the conveying rollers 42, starting from the piece of image receiving paper 32 at the bottom. When the pieces of image receiving paper 32 reach the water applying section 34, they are fed toward the conveying rollers 48, 50 by the rotation of the coating roller 72.

When each piece of image receiving paper 32 has been fed through a predetermine distance in the water applying section 34, the motor 58 is driven so as to incline the guide plates 52, 54, as shown in FIG. 3. As a result, the piece of image receiving paper 32 makes contact with the coating roller 72. The coating roller 72 has already started rotating by this time, lifting up the water 74 in the water tank 70 stabilizing and quickly forming the bead 76 between the piece of image receiving paper 32 and the coating roller 72.

Even if the coating roller 72 starts to rotate when the piece of image receiving paper 32 makes contact with the coating roller 72, the bead 76 is formed, although a certain degree of uneven coating may occur on the forward end of the piece of image receiving paper.

After the bead 76 has been formed, the coating roller 72 is rotated at a fixed speed, maintaining the bead 76. The amount of water 74 applied to the piece of image receiving paper 32 is therefore constant.

When the piece of image receiving paper 32 is fed further so that the rear end of the image transfer portion P approaches the coating roller 72, the rotation of the coating roller 72 slows down, as shown in FIG. 5. As a result, the amount of water 74 lifted up decreases, and the bead 76 formed between the coating roller 72 and the piece of image receiving paper 32 disappears. The bead 76 is made to disappear in the control described above by stopping the rotation of the motor M2. Thereafter, when the rear end of the image transfer portion P reaches the coating roller 72, the motor 48MIis reversed to make the guide plates 52, 54 level.

As a result, the piece of image receiving paper 32 is separated from the coating roller 72, and the water application is thereby completed. Since the bead 76 has disappeared by the time the coating roller 72 and the piece of image receiving paper 32 are separated from each other, no excess water is applied to the rear end of the image transfer portion P.

Figure 6:
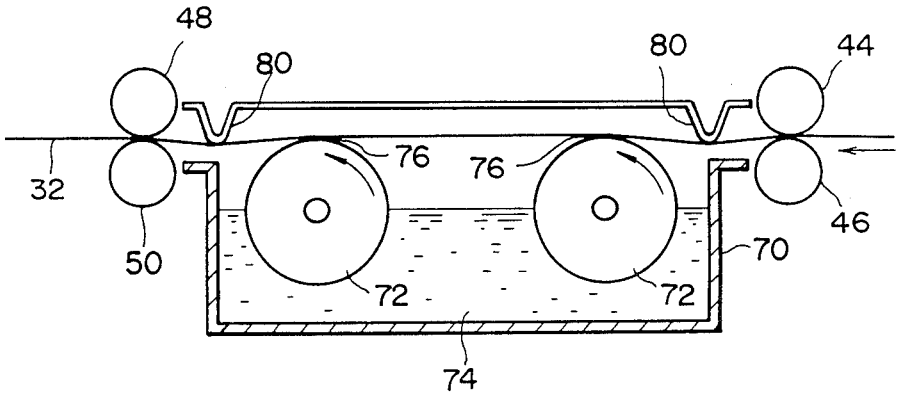
FIG. 6 is a longitudinal cross-sectional view of the water applying section incorporated in a second embodiment of the image recording apparatus according to the present invention.

FIG. 6 shows a second embodiment of the image recording apparatus according to the present invention. The water applying section of this apparatus includes two coating rollers 72, 72 disposed in the water tank 70. The piece of image receiving paper 32 is brought into contact with each of the coating rollers 72, 72 by two lowered pressing members 80 which have a longer span than that of the rollers. The coating rollers 72, 72 are turned by a driving motor in a similar manner to that of the first embodiment, although its construction is not shown.

As a result, a bead 76 is formed between each coating roller and the piece of image receiving paper 32. This provides an improved uniform coating. The length of the bead 76 is effectively long, even if the diameter of the rollers is small, and the time required for the water application can be therefore reduced.

In the two embodiments described above, the pieces of image receiving paper 32 are coated with water. However, the present invention is also applicable to an apparatus in which the water is applied to the light-sensitive material 16.

Experiments of applying water to the light-sensitive material 16 were made under the following conditions:

Conveyed speed of the light-sensitive material 16: 10 to 16 mm/sec

Diameter of the coating roller 72: 33 mm

Rotational speed of the coating roller 72: 500 rpm

Rotational speed of the coating roller 72 at the rear end of the coated portion: 0 rpm (stopped)

Surface roughness of the coating roller 72: 3 to 16 $\mu$

This resulted in the application of 11 $g/m^2$ of water. Further, no excess water was applied to the rear end of the coated portion.

This invention has been described with reference to preferred embodiments. Obviously, numerous constructional and operational modifications and alternations will occur to those skilled in art. It is therefore to be understood that the invention may be practiced otherwise than as specifically described herein, within the scope of the appended claims.

What is claimed is:

1. An image recording apparatus which allows an image to be formed on an image receiving material by transferring an image recorded on a heat-developable light-sensitive photographic material thereto in the presence of an image forming solvent, comprising:

coating means having at least one coating roller for coating the image forming solvent onto the heat-developable light-sensitive material or the image receiving material;

conveying means for conveying said light-sensitive material or said image receiving material above said coating roller;

first driving means for rotating said coating roller so as to perform said coating; and control means for reducing the speed at which said coating roller is rotated, whereby said coating roller continuously applies said solvent to said light sensitive image receiving material without applying said solvent in excess.

2. An image recording apparatus according to claim 1, wherein said control means reduces said rotational speed of said coating roller when a rear end of said light-sensitive material or said image receiving material approaches said coating roller.

3. An image recording apparatus according to claim 2, wherein said control means reduces the rotational speed of said coating roller to zero.

4. An image recording apparatus which allows an image to be formed on an image receiving material by transferring an image recorded on a heat developable light-sensitive photographic material thereto in the presence of an image forming solvent, comprising:

coating means having at least one coating roller for coating the image forming solvent onto the heat developable light-sensitive material or the image receiving material;

conveying means for conveying said light-sensitive material for said image receiving material above said coating roller;

first driving means for rotating said coating roller so as to perform said coating; and control means for controlling the speed at which said coating roller is rotated, wherein said control means is adapted to control the rotational speed of said coating roller at a predetermined value or below when a rear end of said light sensitive material or said image receiving material approaches said coating roller, and wherein said control means controls the rotational speed of said coating roller on the basis of the equation:

$$Q \propto \frac{T \cdot D \cdot n}{v};$$

where Q: the amount of image forming solvent to be applied, T: the temperature of the solvent, D: the diameter of the roller, n: the number of revolutions of the roller, and v: the rotational velocity of the roller.

5. An image recording apparatus according to claim 2, further including sensing means for detecting a light-sensitive material or image receiving material being conveyed so that said control means controls said first driving means on the basis of the detecting signal of said sensing means.

6. An image recording apparatus which allows an image to be formed on an image receiving material by transferring an image recorded on a heat-developable light-sensitive photographic material thereto in the presence of an image forming solvent, comprising:

coating means having at least one coating roller for coating the image forming solvent onto the heat-developable light-sensitive material or the image receiving material;

conveying means for conveying said light-sensitive material or said image receiving material above said coating roller;

first driving means for rotating said coating roller so as to perform said coating;

control means for controlling the speed at which said coating roller is rotated, and sensing means for detecting a light-sensitive material or image receiving material being conveyed so that said control means controls said first driving means on the basis of the detecting signal of said sensing means;

wherein said control means is adapted to control said rotational speed of said coating roller at a predetermined value or below when a rear end of said light-sensitive material or said image receiving material approaches said coating roller; and wherein said conveying means includes: a pair of guide plates for holding and guiding said light-sensitive material or said image receiving material; at least a pair of shafts for supporting said guiding plates; a second driving means for driving said shafts so as to pivot said guiding plates toward or away from said coating roller; and a press roller pivotably supported on said guide plates for pressingt said light-sensitive material or said image receiving material toward said coating roller;

7. An image recording apparatus which allows an image to be formed on an image receiving material by transferring an image recorded on a heat-developable light-sensitive photographic material theeto in the presence of an image forming solvent, comprising:

coating means having at least one coating roller for coating the image forming solvent onto the heat-developable light-sensitive material or the image receiving material;

conveying means for conveying said light-sensitive material or said image receiving material above said coating roller;

first driving means for rotating said coating roller so as to perform said coating;

control means for controlling the speed at which said coating roller is rotated;

wherein said control means is adapted to control said rotational speed of said coating roller at a predetermined value or below when a rear end of said light-sensitive material or said image receiving material approaches said coating roller; and wherein said coating means includes: a water tank for containing said solvent; and two coating rollers having a portion immersed in said solvent and aligned in the direction in which said light-sensitive material or said image receiving material is conveyed, and said conveying means includes: a pair of conveying rollers respectively disposed ahead of and to the rear of said water tank in the direction of conveyance; and a pressing member for pressing the conveyed light-sensitive material or image receiving material toward said two coating rollers;

8. An image recording apparatus according to claim 7, wherein said pressing member has a longer span than that of said two coating rollers.

9. An image recording apparatus according to claim 6, wherein said control means is adapted, in accordance with the signal from said sensing means, to drive said second driving means so as to press said light-sensitive material or said image receiving material against said coating roller by means of said press roller, drive said first driving means so as to rotate said coating roller at a predetermined value, and control the rotational speed of the coating roller in the vicinity of the backward end of said light-sensitive material or said image receiving material at a predetermined value or below.

10. An image recording apparatus according to claim 6, wherein said control means is adapted to drive said second driving means so as to press said light-sensitive material or said image receiving material against said coating roller by means of said press roller and drive said first driving means so as to rotate said coating roller at a fixed speed when a first predetermined time has elapsed from the receipt of the detecting signal from said sensing means, stop said first driving means so as to stop said coating roller when a second predetermined time has elapsed from the start of rotation of said first driving means, and drive said second driving means so as to separate said press roller from said light-sensitive material or said image receiving material when a third predetermined time has elapsed after said first driving means has stopped.

11. An image recording apparatus which allows an image to be formed on an image receiving material by transferring an image recorded on a heat-developable light-sensitive photographic material thereto in the presence of an image forming solvent, comprising:

a vessel for containing said solvent;

at least one coating roller having a portion immersed in said solvent in said vessel;

a first motor for rotating said coating roller;

conveying means for conveying said light-sensitive material or said image receiving material above said coating roller as well as pressing said light-sensitive material or said image receiving material toward said coating roller;

a second motor for driving said conveying means toward said coating roller when turned in the forward direction and away from said coating roller when reversed; and control means for turning said second motor in the forward and reverse directions and controlling the rotational speed of said coating roller.

12. An image recording apparatus according to claim 11, wherein said control means is adapted to control the rotational speed of said coating roller at a predetermined value or below when a rear end of said light-sensitive material or said image receiving material approaches said coating roller.

13. An image recording apparatus according to claim 12, wherein said rotational speed of said coating roller is zero.

14. An image recording apparatus according to claim 12, wherein said control means is adapted to control the rotational speed of said coating roller at a predetermined value or below on the basis of the equation:

$$Q \propto \frac{T \cdot D \cdot n}{v}$$

where Q: the amount of water applied, T: the temperature of the solvent, D: the diameter of the roller, n: the number of revolutions of the roller and v: the rotational velocity of the roller.

15. An image recording apparatus according to claim 12, further including a sensor for detecting when said light-sensitive material or said image receiving material has been conveyed upstream and for sending a detection signal to said control means.

16. An image recording apparatus according to claim 15, wherein said control means is adapted, in accordance with the detection signal from said sensor, to turn said second motor in the forward direction so as to drive said conveying means toward said coating roller and thereby press said light-sensitive material or said image receiving material against said coating roller, drive said first motor so as to rotate said coating roller at a predetermined speed, and set the rotational speed of said first motor in the vicinity of the backward end of said light-sensitive material or said image receiving material at a predetermined value or below.

17. An image recording means according to claim 15, wherein said control means is adapted, in accordance with the signal sent from said sensor, to turn said second motor in the forward direction so as to drive said conveying means toward said coating roller and thereby press said light-sensitive material or said image receiving material against said coating roller, drive said first motor so as to rotate said coating roller at a predetermined speed, stop the rotation of said first motor in the vicinity of the backward end of said light-sensitive material or said image receiving material; and reverse said second motor so as to drive said conveying means away from said coating roller.

18. An image recording apparatus according to claim 16, wherein said conveying means includes: a pair of guide plates for supporting the lateral edges of said light-sensitive material or said image receiving material and guiding it; a press roller rotatably supported on said guide plates; and a shaft for supporting said guide plates and driving said guide plates toward and away from said coating roller by the rotation of said second motor in the forward and reverse directions.

19. An image recording apparatus according to claim 12, wherein said coating roller consists of two rollers aligned in the direction in which said light-sensitive material or said image receiving material is conveyed, and said conveying means includes a pressing member for pressing said light-sensitive material or said image receiving material toward said two coating rollers.

20. An image recording apparatus according to claim 19, wherein said pressing member has a span which is greater than that of said two coating rollers.

21. An image recording apparatus according to claim 1, wherein said conveying means includes a means for pivotably moving said light-sensitive material or said image receiving material into and out of contact with said coating roller.

* * * * *